US010283916B2

(12) United States Patent
Urrea et al.

(10) Patent No.: US 10,283,916 B2
(45) Date of Patent: May 7, 2019

(54) FUSE ASSEMBLY

(71) Applicant: Littelfuse, Inc., Chicago, IL (US)

(72) Inventors: Julio Urrea, Chicago, IL (US); Gary M. Bold, Palatine, IL (US)

(73) Assignee: LITTELFUSE, INC., Chicago, IL (US)

( * ) Notice: Subject to any disclaimer, the term of this patent is extended or adjusted under 35 U.S.C. 154(b) by 383 days.

(21) Appl. No.: 14/157,188

(22) Filed: Jan. 16, 2014

(65) Prior Publication Data

US 2014/0134881 A1 May 15, 2014

Related U.S. Application Data

(63) Continuation of application No. 13/230,278, filed on Sep. 12, 2011, now Pat. No. 8,665,056, which is a continuation-in-part of application No. 13/109,831, filed on May 17, 2011, now Pat. No. 8,669,840.

(60) Provisional application No. 61/345,840, filed on May 18, 2010, provisional application No. 61/409,837, filed on Nov. 3, 2010.

(51) Int. Cl.

| | |
|---|---|
| ***H01R 13/68*** | (2011.01) |
| ***H01H 85/12*** | (2006.01) |
| ***H01H 85/044*** | (2006.01) |
| ***H01H 85/20*** | (2006.01) |
| *H01H 85/02* | (2006.01) |
| *H01H 85/055* | (2006.01) |

(52) U.S. Cl.

CPC ..... *H01R 13/68* (2013.01); *H01H 85/044* (2013.01); *H01H 85/12* (2013.01); *H01H 85/205* (2013.01); *H01H 2085/025* (2013.01); *H01H 2085/0555* (2013.01)

(58) Field of Classification Search

CPC .... H01H 85/044; H01H 85/12; H01H 85/175; H01H 85/2045; H01H 85/205; H01H 85/22; H01H 2085/0233; H01H 2085/025; H01H 2085/0555; H01H 2085/206; H01H 2085/2075–2085/209; H01R 13/68–13/696

USPC ..... 337/188–189, 191, 227, 256; 439/620.27

See application file for complete search history.

(56) References Cited

U.S. PATENT DOCUMENTS

| | | | |
|---|---|---|---|
| 3,323,021 | A | 5/1967 | Sever |
| 3,969,695 | A | 7/1976 | Belcher |

(Continued)

FOREIGN PATENT DOCUMENTS

| | | | |
|---|---|---|---|
| CN | 201397795 | Y | 2/2010 |
| DE | 102007019569 | A | 11/2007 |

(Continued)

*Primary Examiner* — Jacob R Crum

(57) ABSTRACT

A circuit protection assembly includes a mounting block, a unitary fuse assembly, a post assembly and a plug connector. The unitary fuse assembly is disposed the mounting block and includes a plurality of fuses each of which is defined by a portion of a bus plate disposed on the lower surface of the mounting block to form a first terminal of the fuse, a second terminal disposed at least partially on the upper surface of the mounting block and a fuse element connecting the first terminal and the second terminal. The post assembly is disposed at least partially within the mounting block and a post extending from the block. The plug connector extends from a portion of the first terminal of at least one of the plurality of fuses.

5 Claims, 14 Drawing Sheets

(56) References Cited

U.S. PATENT DOCUMENTS

| | | | | |
|---|---|---|---|---|
| 4,344,060 | A * | 8/1982 | Ciesemier | H01H 85/0417 29/623 |
| 5,451,170 | A | 9/1995 | Suffi | |
| 5,805,047 | A | 9/1998 | De Villeroche et al. | |
| 5,816,858 | A * | 10/1998 | Kazarian | H01H 85/2045 439/366 |
| 5,841,338 | A * | 11/1998 | Yasukuni | H01H 85/0411 337/164 |
| 5,854,583 | A | 12/1998 | Falchetti | |
| 6,294,978 | B1 | 9/2001 | Endo et al. | |
| 6,371,791 | B1 | 4/2002 | Newton, Jr. | |
| 6,456,188 | B1 | 9/2002 | Tsuchiya | |
| 6,509,824 | B2 | 1/2003 | Inaba et al. | |
| 6,902,434 | B2 | 6/2005 | Stack | |
| 6,910,923 | B2 | 6/2005 | Nakanishi | |
| 6,932,650 | B1 | 8/2005 | Freitag | |
| 6,985,065 | B2 | 1/2006 | Aguila | |
| 7,172,462 | B1 | 2/2007 | Gronowicz, Jr. | |
| 7,192,319 | B1 | 3/2007 | Rahman et al. | |
| 7,323,956 | B1 | 1/2008 | Puskar et al. | |
| 7,420,453 | B2 | 9/2008 | Matsumara et al. | |
| 7,429,906 | B2 | 9/2008 | Korszynski | |
| 7,663,466 | B1 | 2/2010 | Jetton | |
| 7,924,137 | B2 | 4/2011 | Rahman et al. | |
| 7,978,046 | B2 | 7/2011 | Ohashi et al. | |
| 7,990,738 | B2 | 8/2011 | Urrea et al. | |
| 2004/0018417 | A1 | 1/2004 | Stack | |
| 2005/0250389 | A1 | 11/2005 | Johansen et al. | |
| 2008/0050981 | A1 | 2/2008 | Pavlovic et al. | |
| 2009/0023334 | A1 | 1/2009 | Puschkat | |
| 2009/0066469 | A1 | 3/2009 | Rahmnan et al. | |
| 2011/0148564 | A1 | 6/2011 | Staylor | |
| 2011/0285496 | A1 | 11/2011 | Urrea et al. | |
| 2012/0064771 | A1 | 3/2012 | Urrea et al. | |

FOREIGN PATENT DOCUMENTS

| | | | |
|---|---|---|---|
| JP | H02-20228 | U | 2/1990 |
| JP | H04215225 | A | 8/1996 |
| JP | 2006313686 | A | 11/2006 |
| JP | 2009289602 | A | 12/2009 |

* cited by examiner

FUSE ASSEMBLY

CROSS-REFERENCE TO RELATED APPLICATIONS

This application is a continuation of pending U.S. patent application Ser. No. 13/230,278, filed Sep. 12, 2011, which is a continuation-in-part of U.S. patent application Ser. No. 13/109,831 filed May 17, 2011, which claims priority to U.S. Provisional Patent Application No. 61/345,840 filed May 18, 2010, and U.S. Provisional Patent Application No. 61/409,837, filed Nov. 3, 2011, the entireties of which applications are incorporated by reference herein.

FIELD OF THE INVENTION

Embodiments of the invention relate to the field of circuit protection devices. More particularly, the present invention relates to a fuse assembly employing a post arrangement that is easier to manufacture and provides a built-in insulating configuration with the fuse.

DISCUSSION OF RELATED ART

Fuses are used as circuit protection devices and form an electrical connection between a power source and a component in a circuit to be protected. In particular, a fuse may be configured to protect against damage caused by an overcurrent condition. A fuse is constructed to physically open or interrupt a circuit path and isolate electrical components from damage upon the occurrence of specified overvoltage and/or overcurrent conditions in the circuit.

Electrical systems in vehicles typically include a number of these types of circuit protection devices to protect electrical circuitry, equipment, and components from damage caused by these conditions. For example, power sources (e.g. batteries) in vehicles utilize a fuse fitted over a terminal post to which a ring terminal of an electrical cable is connected. A nut is usually threaded onto the post to keep the ring terminal and fuse in position. When an excess current condition exists, the fuse on the terminal post protects the components connected to the power source from this excess current. Unintended shorting occurs when the ring terminal comes into direct electrical contact with the post rather than through the fuse. To overcome this problem, an insulating nut fitted over the post has been used to isolate the fuse and the ring terminal to prevent current from bypassing the fuse and damaging the protected circuit.

In certain applications, a single source of power may be shared with a plurality of these fuse arrangements to distribute power to multiple circuits. For example, FIG. 1 is a side cross-sectional view of a fuse assembly 10 illustrating a housing or block 20 from which a post 25 extends and on which fuse 30 is mounted. A ring terminal 40 is fitted over post 25. Ring terminal 40 is connected to a power cable 41 to supply power to an electrical circuit to be protected. Ring terminal 40 is configured to make electrical contact with an upper terminal of fuse 30, but is insulated from post 25. In this configuration, power is supplied to a bus bar 45 disposed in block 20 which is connected to a lower terminal of fuse 30. In this manner, fuse 30 connects the bus bar 45 with ring terminal 40 via fuse element 35. When an overcurrent condition occurs, the fuse element 35 opens or otherwise prevents the flow of current from the bus bar 45 to ring terminal 40 thereby protecting the electrical circuit. Post 25 is molded within block 20 which is typically made from plastic. Unfortunately, by molding one end of post 25 into block 20, additional manufacturing steps and associated costs are incurred. Accordingly, there is a need to provide a fuse assembly that includes a post or terminal portion that is easier to manufacture and provides an insulating configuration to prevent unnecessary short circuits. In addition, vehicle electrical system complexity is increasing which consequently increases the number of electrical circuits to be protected therein. This necessitates the need for more and more fuse elements. However, there is a conflicting interest to keep such protection circuits compact, light weight and easily replaceable to conserve valuable vehicle space and weight footprints. It is with respect to these and other considerations that the present improvements have been needed.

SUMMARY OF THE INVENTION

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Exemplary embodiments of the present invention are directed to a protection device disposed between a source of power and a circuit to be protected. In an exemplary embodiment, a circuit protection assembly comprises a mounting block, a unitary fuse assembly, a post assembly and a plug connector. The mounting block includes an upper and lower surface. The unitary fuse assembly is disposed at least partially around the mounting block and has a plurality of fuses each of which is defined by a portion of a bus plate disposed on the lower surface of the mounting block to form a first terminal of the fuse, a second terminal disposed at least partially on the upper surface of the mounting block and a fuse element connecting the first terminal and the second terminal. The post assembly is disposed at least partially within the mounting block and a post extending from the block. The plug connector extends from a portion of the first terminal of at least one of the plurality of fuses.

DESCRIPTION OF EMBODIMENTS

Figure 1:
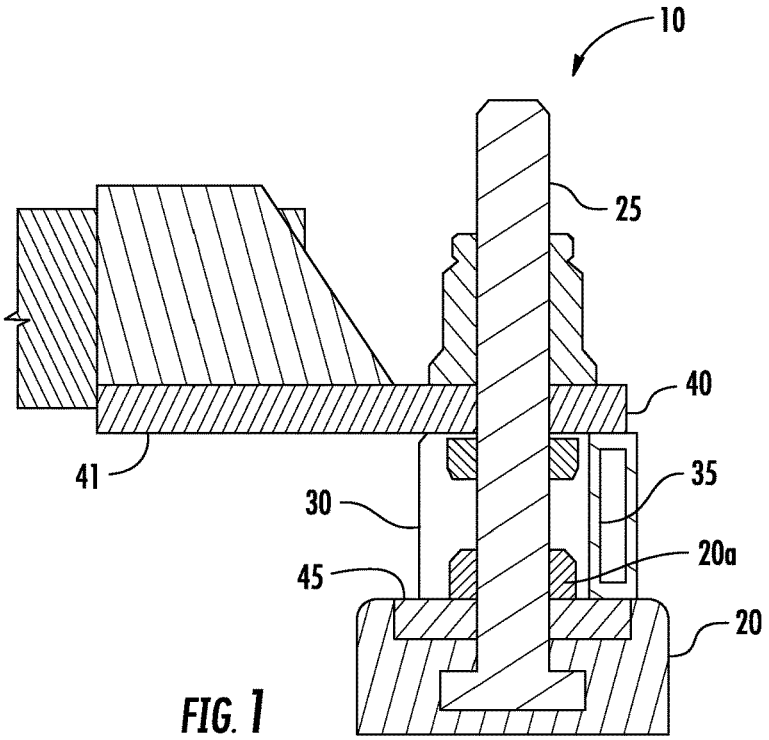
FIG. 1 illustrates a prior art fuse assembly employing a post integrally molded with an block.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

Figure 2A:
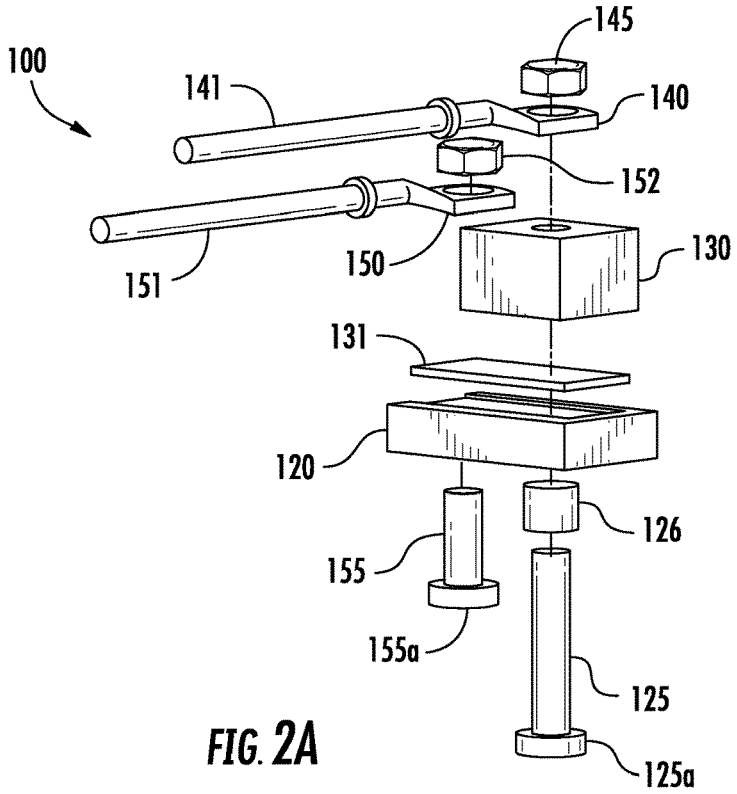
FIG. 2A illustrates an exploded perspective view of an exemplary fuse assembly in accordance with an embodiment of the present disclosure.
Figure 3B:
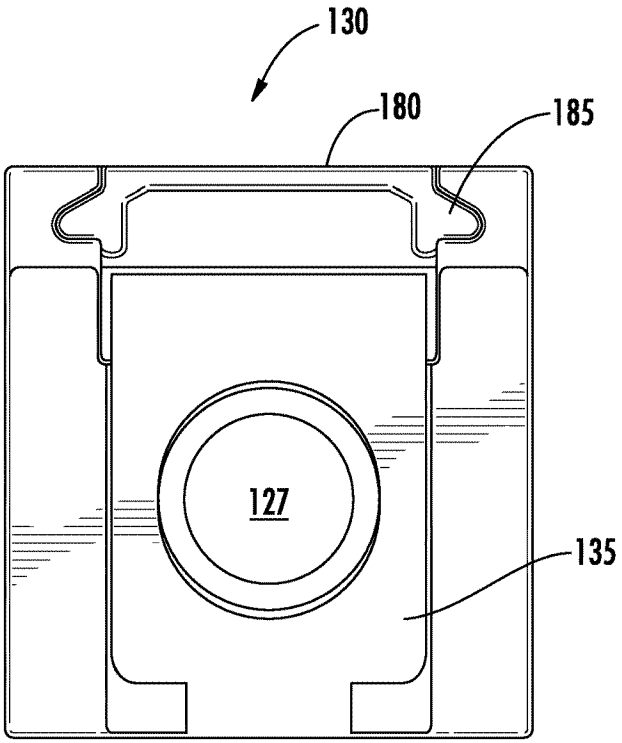
FIG. 3B is a top plan view of a fuse utilized in an assembly in accordance with an embodiment of the present disclosure.

FIG. 2A is a perspective view of a fuse assembly 100 including a housing or block 120 on which one or more fuses 130 are mounted. In this illustration, one fuse 130 is shown with two posts 125 and 155 where post 155 supplies power to a bus plate 131 and post 125 receives fuse 130. In particular, first post 125 is disposed through a receiving bore in block 120 and a corresponding bore in bus plate 131. Fuse 130 may be a ceramic "block" fuse having a generally central aperture (as shown in FIG. 3B) that receives post 125. An insulator 126 isolates post 125 from fuse 130. Ring terminal 140, connected to cable 141, is mounted over post 125 and nut 145 threadedly engages the post to retain both the fuse and the ring terminal in position. A second post 155 extends through block 120 and is in electrical contact with bus bar 131 to provide power thereto. Post 155 is also threaded and receives ring terminal 150 and nut 155. Cable 151 is connected to post 155 via ring terminal 150 to distribute power to the fuse assembly via bus bar 131. In this manner, a circuit is formed from ring terminal 150, to bus plate 131, through fuse 130, to ring terminal 140 to a component and/or circuit to be protected. Thus, power is supplied to the assembly at one location (e.g. ring terminal 150 and bus plate 131) and distributed to circuits through respective fuse assemblies (e.g. fuse 130).

Figure 2B:
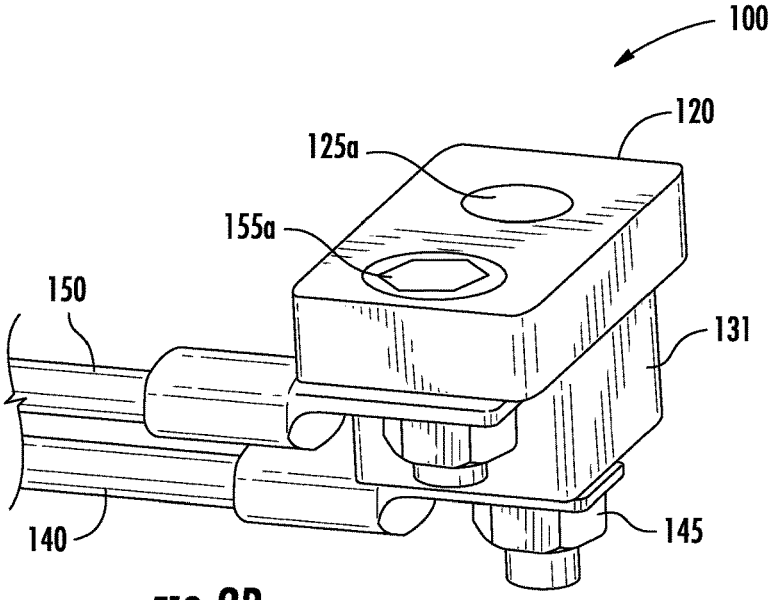
FIG. 2B illustrates a perspective bottom view of the fuse assembly of FIG. 2A in accordance with an embodiment of the present disclosure.

FIG. 2B is a bottom view of assembly 100 illustrating the retaining configuration of posts 125 and 155 within block 120. In particular, the bottom side of block 120 includes recesses sized slightly larger than the heads of each post 125, 155 within which these heads are disposed such that the respective posts are secured in position through block 120. Posts 125 and 155 may be force fit into respective recesses of block 120 where the recesses have the same shape as respective heads of each post 125, 155 with body portions of each of the posts extending through block 120. In this manner, the posts do not need to be integrally molded with block 120, thereby reducing manufacturing and labor costs.

Figure 2C:
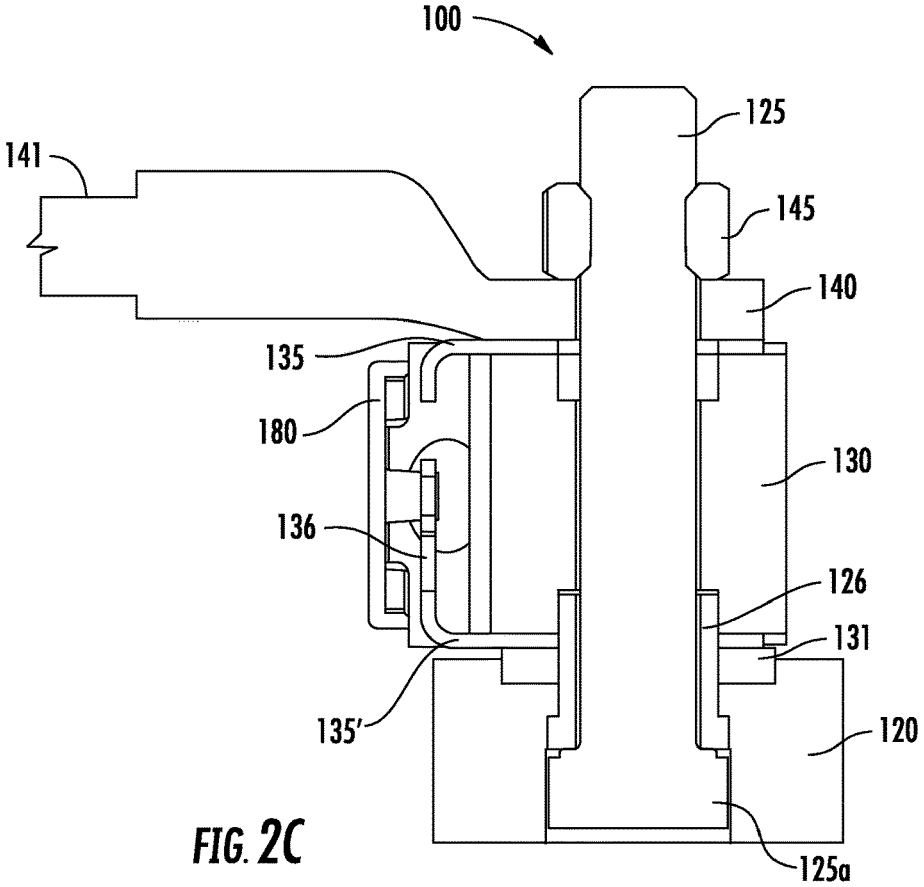
FIG. 2C is a cross-sectional side view of a portion of a fuse assembly shown in FIGS. 2A and 2B.

FIG. 2C is a cross-sectional side view of a portion of a fuse assembly shown in FIGS. 2A and 2B. As can be seen, the head 125*a* of post 125 is recessed within block 120, but not molded therein. Insulator 126, which is a separate component and not molded as part of block 120, extends from the head 125*a* along post 125 into a lower end of fuse 130 to insulate the post 125 from bus bar 131. By not molding post 125 and insulator 126 within block 120, manufacturing costs are conserved. The fusible element 136 is connected to a lower fuse terminal 135' which is in electrical contact with bus bar 131. In normal operating conditions, an electrical connection is formed between bus bar 131, lower fuse terminal 135', fusible element 136, upper fuse terminal 135 and ring terminal 140. When an overcurrent event occurs, fusible element 136 is blown or otherwise breaks this electrical connection.

Figure 3A:
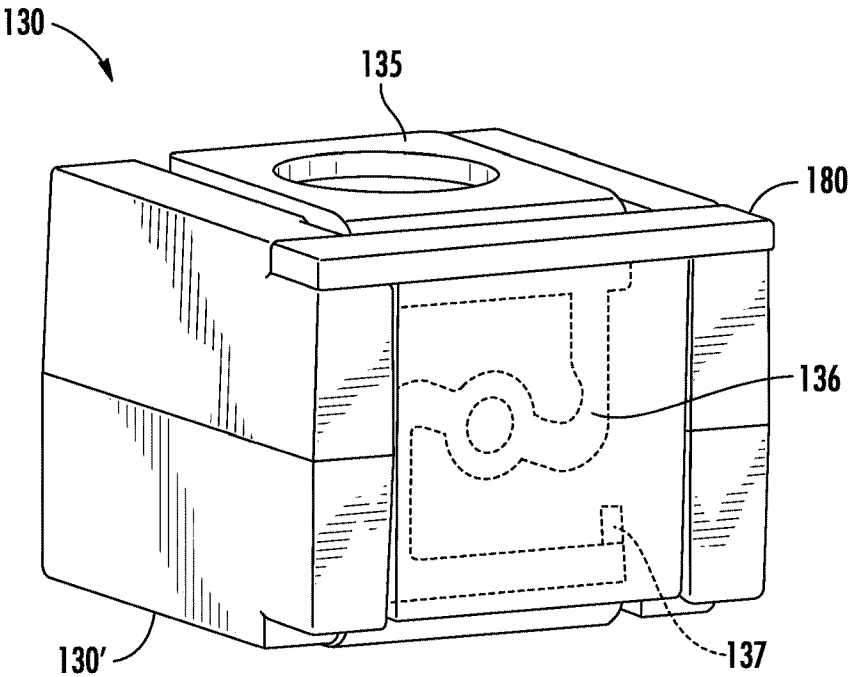
FIG. 3A illustrates an exploded perspective view of a fuse utilized in an assembly in accordance with an embodiment of the present disclosure.

FIG. 3A is a perspective view of a block fuse 130 and FIG. 3B is a top plan view thereof. Fuse 130 is defined by a housing 130' which may be made from, for example, a ceramic material, and has a centrally disposed aperture 127 through which post 125 is received. Fuse 130 includes a fuse element 136 which is in electrical contact with ring terminal 140 via terminal 135 to provide an electrical path to a circuit to be protected for power supplied to bus bar 131. Fuse element 136 may also include a retaining flange 137 which extends toward housing 130' to assist in the retention thereof. Fuse 130 also includes a cover 180 which protects fusible element 136 from ambient particles as well as acting to contain arcing when the fuse is blown due to an overcurrent condition. The cover is at least partially disposed in grooves 185 of fuse body 130' which helps to retain the cover in position.

Figure 4A:
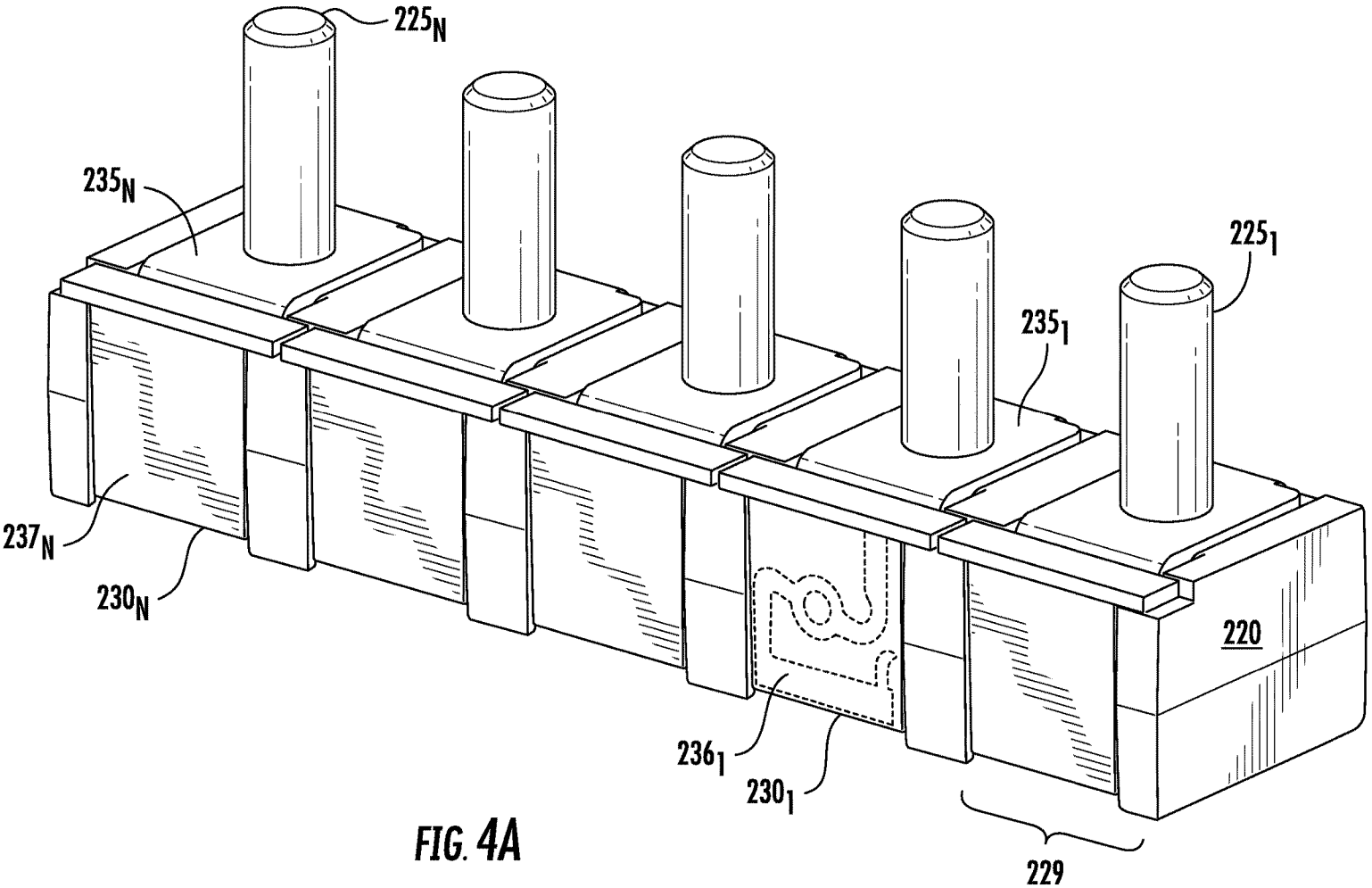
FIGS. 4A-4D are various perspective views of an assembly in accordance with an alternative embodiment of the present disclosure.

FIGS. 4A-4D are various perspective views of an assembly 200 in accordance with an alternative embodiment of the present disclosure. Instead of separate fuses 130 shown in FIGS. 2-3, this embodiment incorporates fuses $\mathbf{230}_1 \ldots \mathbf{230}_N$ and block 220 into a unitary assembly. In particular, FIG. 4A illustrates a block 220 including a bus bar 231 disposed on the bottom of the block that extends the length of the block (see FIG. 4D). A first portion 229 of the assembly 200 defines a connection to a power supply when a power supply cable is connected to post $\mathbf{225}_1$. The bus bar 231 is connected to post $\mathbf{225}_1$ via an electrical connection (not shown) around the outside of block 220. The remaining portions of block 220 define fuses $\mathbf{230}_1 \ldots \mathbf{230}_N$ each having separate fuse elements $\mathbf{236}_1 \ldots \mathbf{236}_N$ connecting bus bar 231 which acts as a first terminal for each fuse to a second terminal $\mathbf{235}_1 \ldots \mathbf{235}_N$. As shown, fuse element $\mathbf{236}_1$ is used to electrically connect bus bar 231 to a terminal $\mathbf{235}_1$ to define fuse $\mathbf{230}_1$. Each of the fuses $\mathbf{230}_1 \ldots \mathbf{230}_N$ may also include covers $\mathbf{237}_N$ which cover respective fusible elements $\mathbf{236}_1 \ldots \mathbf{236}_N$.

Figure 4B:
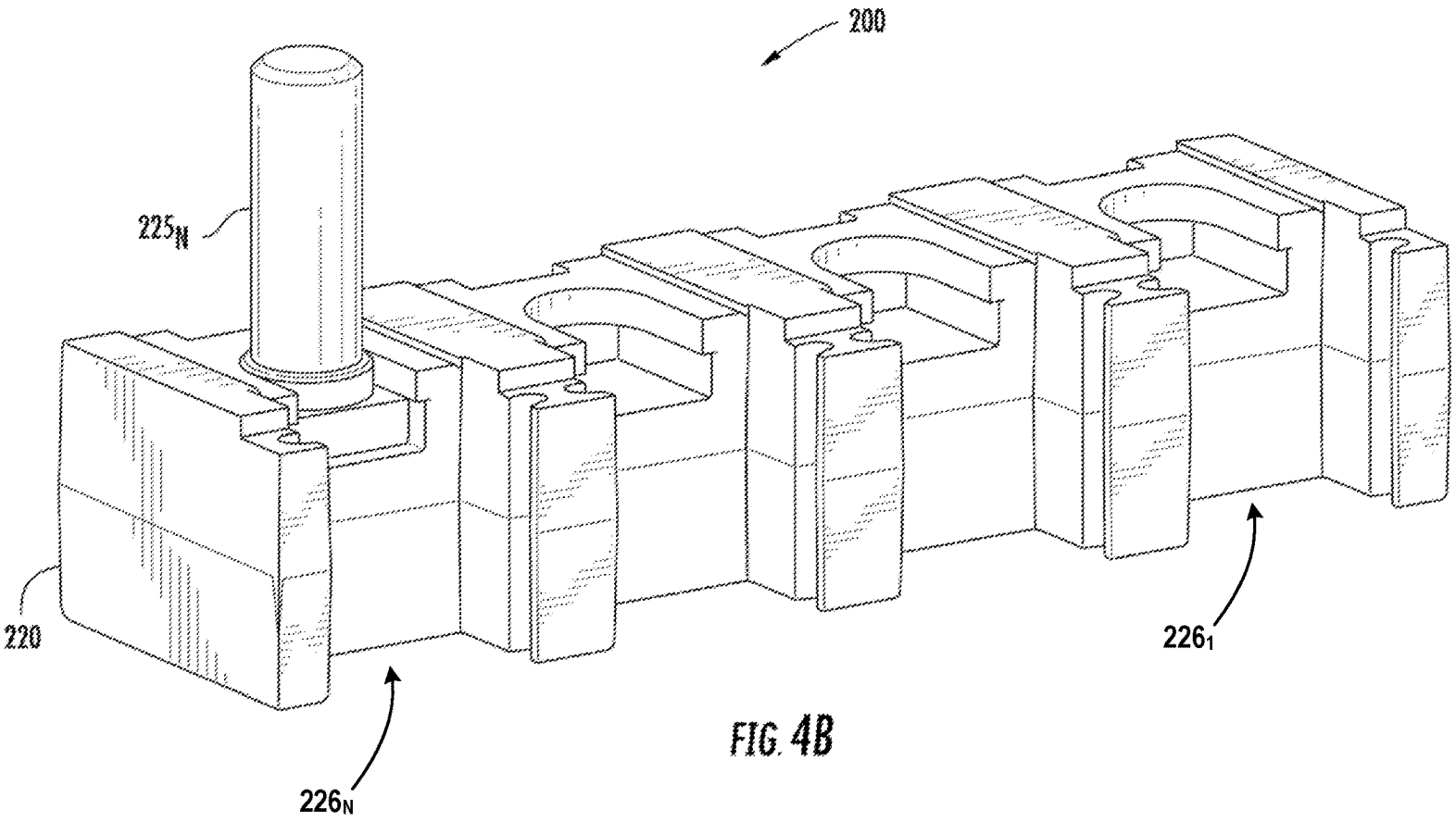

FIG. 4B is used to illustrate just the posts $\mathbf{225}_1 \ldots \mathbf{225}_N$ and block 220 without the fusible elements or busbar to show how the posts are positioned within recesses of block 220 for connection to a ring terminal. In particular, block 220 is shown with empty recesses $\mathbf{226}_1 \ldots \mathbf{226}_N$ where the fuse elements $\mathbf{231}_1 \ldots \mathbf{236}_N$ would be disposed. The head of each post $\mathbf{225}_1 \ldots \mathbf{225}_N$ is positioned in block 220. This allows each post to only extend from block 220 through a respective terminal $\mathbf{235}_1 \ldots \mathbf{235}_N$ of each fuse. This eliminates the need to insulate each of the posts $\mathbf{225}_1 \ldots \mathbf{225}_N$ since each post only protrudes through a corresponding one of the terminals $\mathbf{235}_1 \ldots \mathbf{235}_N$ and does not contact bus bar 231. In addition, since no insulator is used, the compression forces that exist once a fuse is mounted on a post $\mathbf{225}_1 \ldots \mathbf{225}_N$ are limited to the contact point between the post and the respective fuse terminal. In this manner, each post $\mathbf{225}_N$ is in direct contact with a respective terminal $\mathbf{235}_N$ of a corresponding fuse $\mathbf{230}_N$. This eliminates the need for an insulator to be used which can withstand the compression force of a bolt down joint since all the compression force is directly between the fuse terminal and a respective post. In previous designs, specialty plastics were needed to form the insulators as well as block 220. These costly specialty plastics were selected to withstand heat during use as well as the compression forces generated when a fuse is bolted to a post. In contrast, since the posts of the present disclosure $\mathbf{225}_1 \ldots \mathbf{225}_N$ do not extend through the block 220, this obviates the need for a costly high temperature plastic or ceramic to be used that can withstand these compression forces.

Figure 4C:
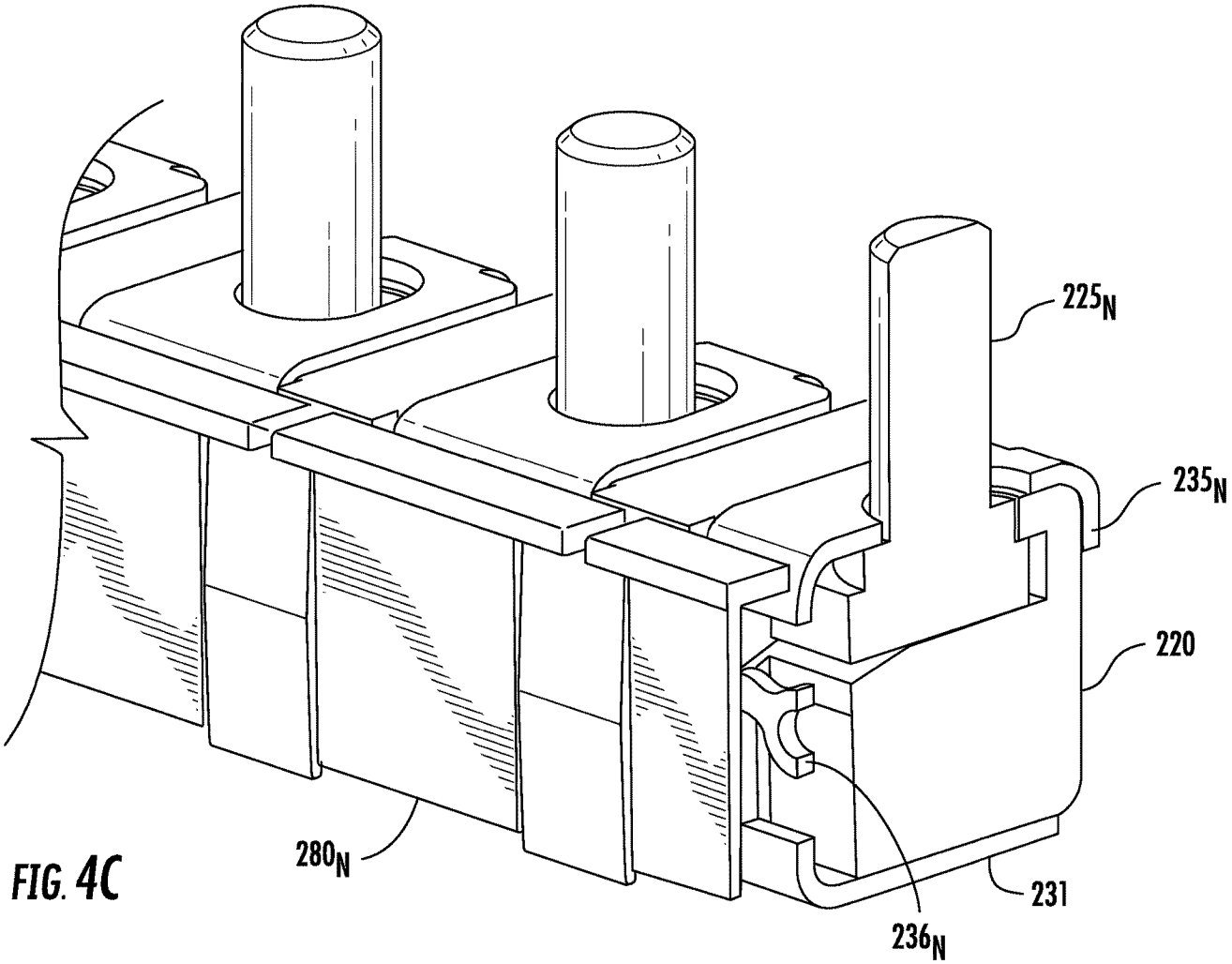
Figure 4D:
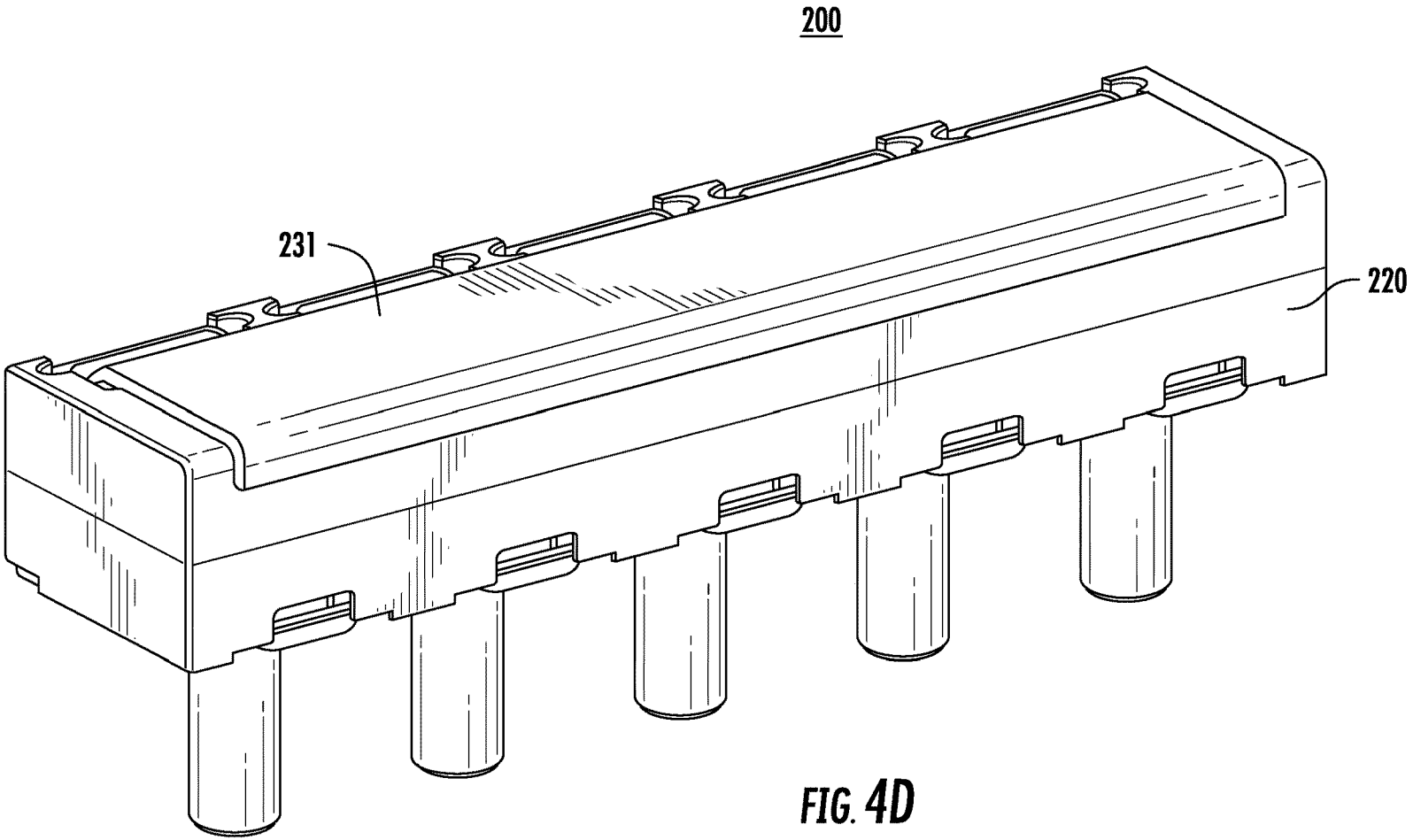

FIG. 4C is a cut-away cross section of the assembly showing a particular fuse $\mathbf{230}_N$ having a first terminal defined by a corresponding portion of bus bar 231, second terminal $\mathbf{235}_N$ connected by a fuse element $\mathbf{236}_N$ and a post $\mathbf{225}_N$ that extends upward through an aperture in second terminal $\mathbf{235}_N$ for connection to a ring terminal. Each fuse also includes a cover $\mathbf{280}_N$ as described in FIG. 3B which protects the respective fusible element $\mathbf{236}_N$.

Figure 5:
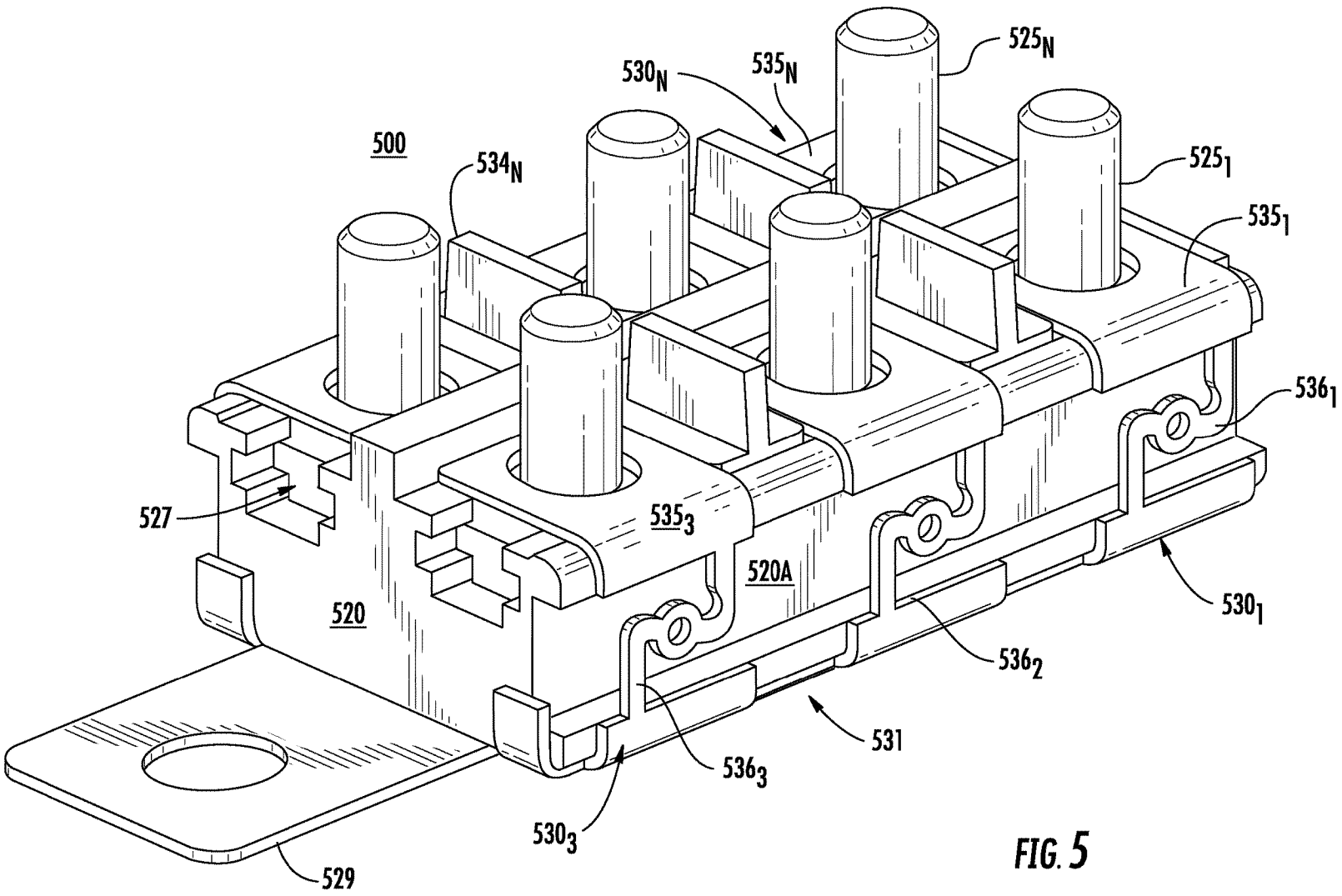
FIG. 5 is a perspective view of an exemplary embodiment in accordance with alternative embodiments of the present disclosure.
Figure 6A:
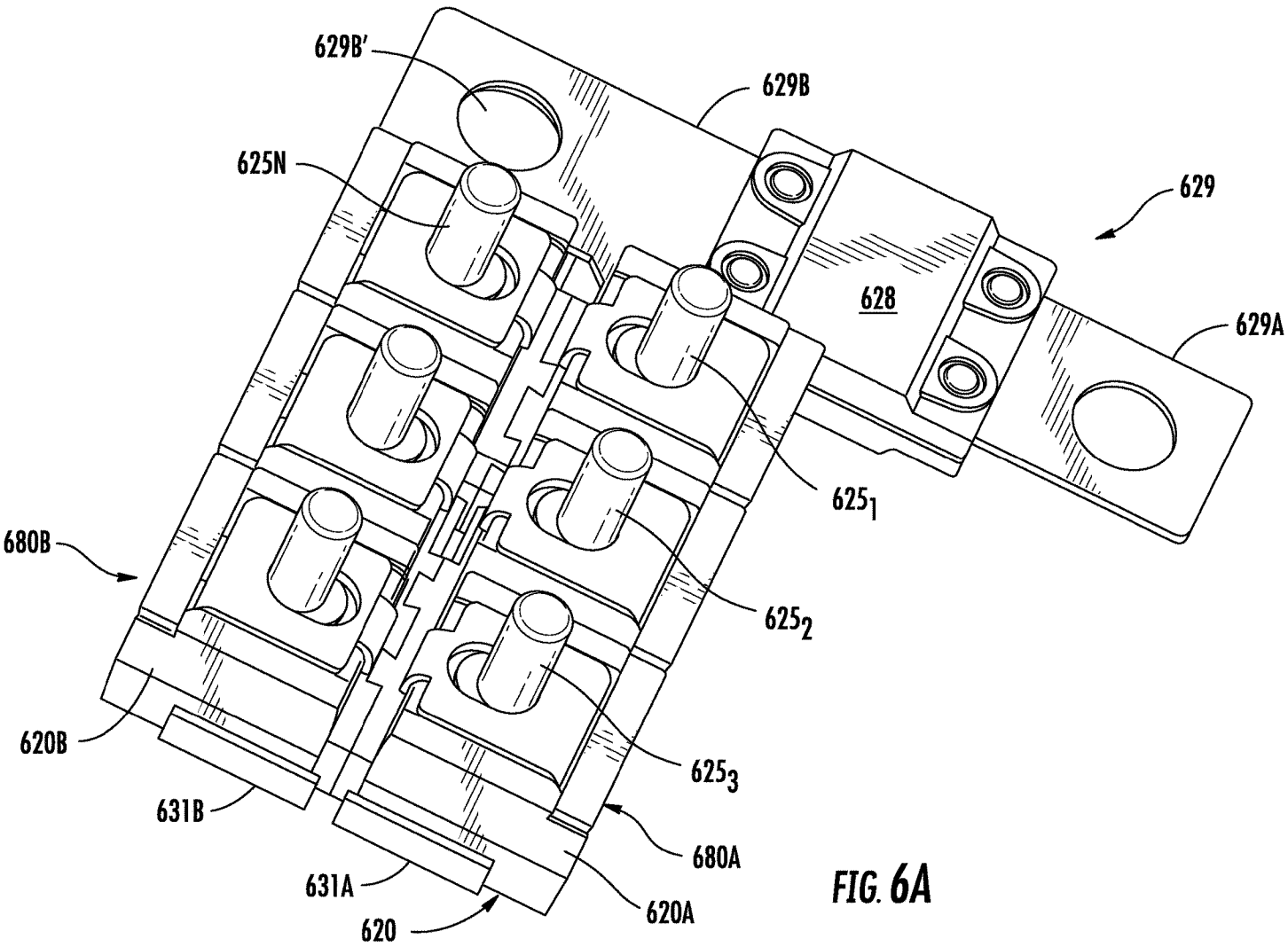
FIGS. 6A-6B are perspective views of an exemplary embodiment in accordance with alternative embodiments of the present disclosure.
Figure 6B:
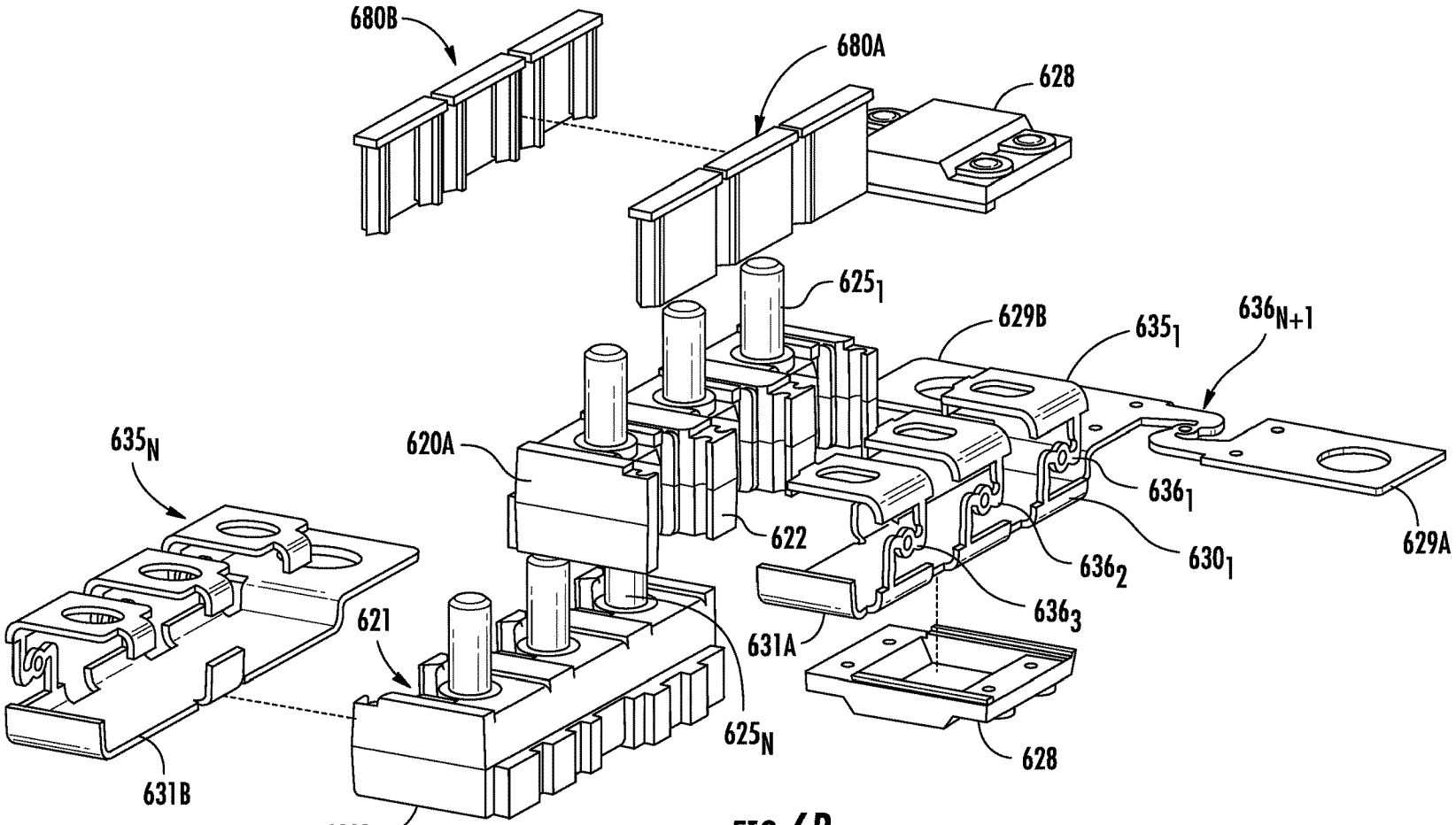
Figure 7:
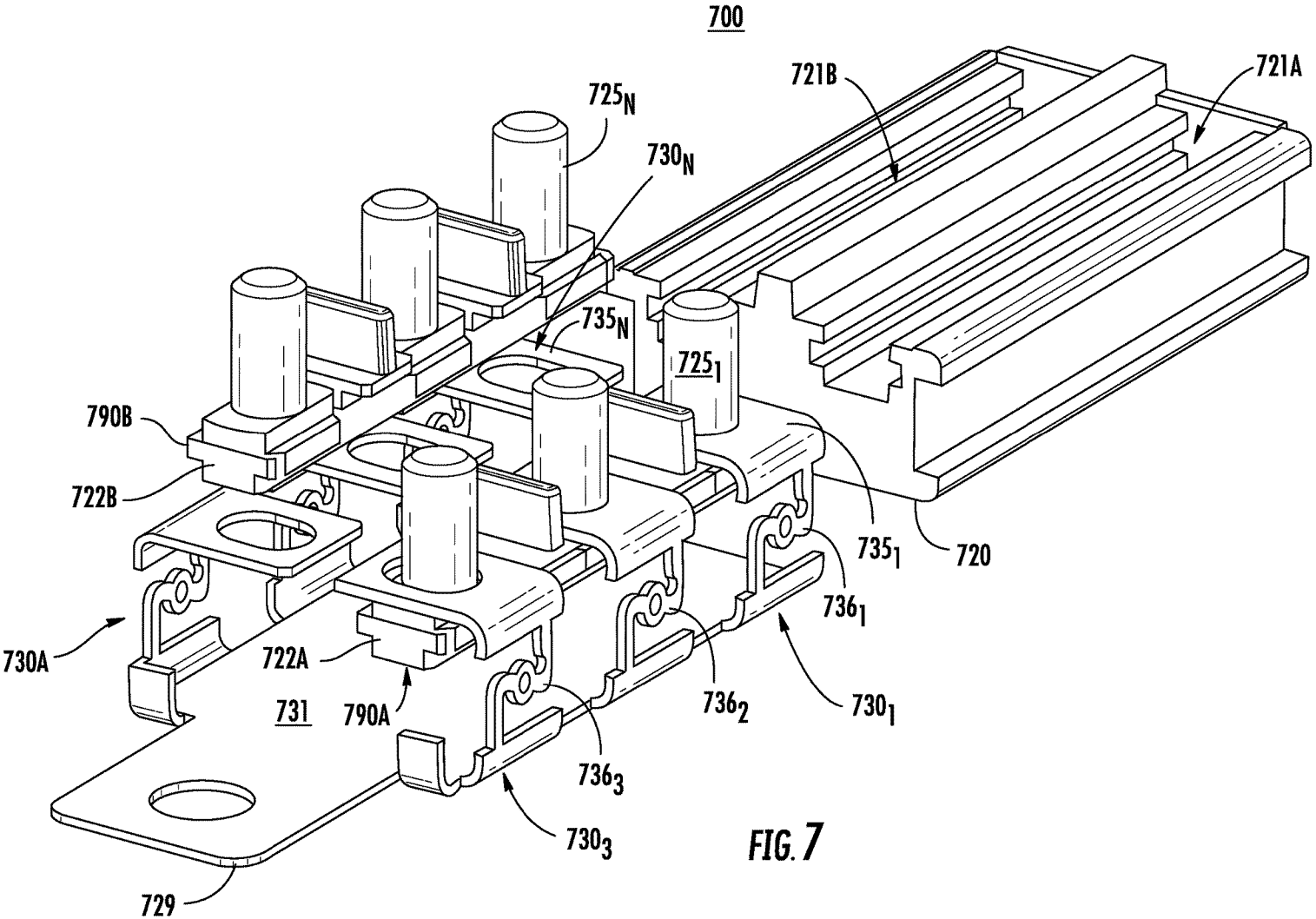
FIG. 7 is an exploded perspective view of an exemplary embodiment in accordance with the present disclosure.

FIGS. 5-7 are various views of assemblies in accordance with alternative embodiments of the present disclosure including different configurations of the terminals, block, posts and fusible elements. FIG. 5 illustrates assembly 500 comprising a block 520 with a pair wise or side-by-side post $\mathbf{525}_1 \ldots \mathbf{525}_N$ configuration adapted to receive block fuses (e.g. 130 shown in FIG. 3A). Block 520 may be a unitary piece of, for example, plastic, including a bus bar 531 disposed on the bottom of the block 520 that extends the length and width of the block. A first portion 529 of the bus bar 531 of the assembly 500 defines a connection to a power supply when a power supply cable is connected thereto.

Fuses $\mathbf{530}_1 \ldots \mathbf{530}_N$ each have separate fuse elements $\mathbf{536}_1 \ldots \mathbf{536}_N$ connecting bus bar 531 which acts as a first terminal for each fuse to a corresponding second terminal $\mathbf{535}_1 \ldots \mathbf{535}_N$ of the fuse. For example, fuse element $\mathbf{536}_1$ is used to connect bus bar 531 to terminal $\mathbf{535}_1$ to define fuse $\mathbf{530}_1$. Each of the fusible elements is disposed a distance away from wall 520A of block 520 since the temperature of each of the fusible elements increases during use and should not come in contact with the plastic material of block 520.

Each of a plurality of posts $\mathbf{525}_1 \ldots \mathbf{525}_N$ is positioned in block 520 via grooved recesses 527. This allows each post to only extend from block 520 through a respective second terminal $\mathbf{535}_1 \ldots \mathbf{535}_N$ and does not contact bus bar 531. As stated above with respect to the previous embodiments, since the posts do not extend all the way through the block 520, this obviates the need for a costly high temperature plastic or ceramic to be used for the block capable of withstanding compression forces when terminals are connected to the posts. Spacers or guards $\mathbf{534}_N$ may be disposed between each of terminals $\mathbf{535}_N$ to separate each of the terminals $\mathbf{535}_1 \ldots \mathbf{535}_N$ and post combinations.

FIGS. 6A-6B illustrate another embodiment of an assembly 600 in accordance with the present disclosure. FIG. 6A is a top perspective view of assembly 600 and FIG. 6B is a perspective exploded view of the same assembly 600. Assembly 600 includes a block 620 defined by a first sub-block 620A and a second sub-block 620B. In this embodiment, the bus bar (e.g. 531 shown in FIG. 5) is defined by a first portion 631A positioned on the bottom of first sub-block 620A and a second sub-portion 631B positioned on the bottom of second sub-block 620B. The bus bar portions 620A, 620B define a first terminal of each of the fuses $\mathbf{630}_1 \ldots \mathbf{630}_N$ and the second terminal is defined by respective portions $\mathbf{635}_1 \ldots \mathbf{635}_N$. Each of the posts $\mathbf{625}_1 \ldots \mathbf{625}_N$ is adapted to receive exemplary ring terminals shown, for example, in FIGS. 1 and 2.

A connection portion 629 receives a power supply cable for the assembly 600. The connection portion 629 is defined by a first connection portion 629A adapted to receive, for example, a ring terminal of the power supply cable and a second connection portion 629B via aperture 629B'. An additional fusible element $\mathbf{636}_{N+1}$ (shown more clearly in FIG. 6B) may be disposed between first and second connection portions 629A and 629B and disposed within housing 628.

FIG. 6B illustrates an exploded view of assembly 600 in which the fuse portions $\mathbf{630}_1 \ldots \mathbf{630}_N$ are shown as a unitary section defined by respective bus bar portions 631A and 631B, fusible elements $\mathbf{636}_1 \ldots \mathbf{636}_N$ and terminals $\mathbf{635}_1 \ldots \mathbf{635}_N$. These unitary pieces are disposed around respective block portions 620A and 620B with posts $\mathbf{625}_1 \ldots \mathbf{625}_N$ protruding through aperture in each of the upper terminals $\mathbf{635}_1 \ldots \mathbf{635}_N$. A first cover 680A and a second cover 680B are used to cover respective fusible elements $\mathbf{636}_1 \ldots \mathbf{636}_N$. A first side of each of sub-blocks 620A and 620B has recesses 621 and protrusions 622 that are aligned to fit the two sub-blocks together to form block 620.

FIG. 7 is an exploded perspective view of an alternative assembly 700 in accordance with the present disclosure. In this embodiment, block 720 is a unitary piece and is configured to receive a unitary fuse assembly shown generally as 730A. The unitary assembly 730A is defined by bus bar 731 and fuses $\mathbf{730}_1 \ldots \mathbf{730}_N$. The bus bar 731 forms the first terminal of each of the fuses and second terminals $\mathbf{735}_1 \ldots \mathbf{735}_N$ are electrically connected to the first terminal via fusible elements $\mathbf{736}_1 \ldots \mathbf{736}_N$ disposed therebetween, respectively.

Block 720 includes a first and second recesses 721A, 721B which are configured to receive first and second post blocks 722A, 722B of first and second post assembly 790A and 790B (790A is shown positioned within unitary assembly 730A and 790B is shown outside of unitary assembly 730A for ease of illustration). In this manner, a block 720 slides into the unitary assembly and receives the post assemblies 790A and 790B or unitary assembly 730A slides over block 720 with post assemblies 790A and 790B at least partially disposed within recesses 721A and 721B.

Figure 8A:
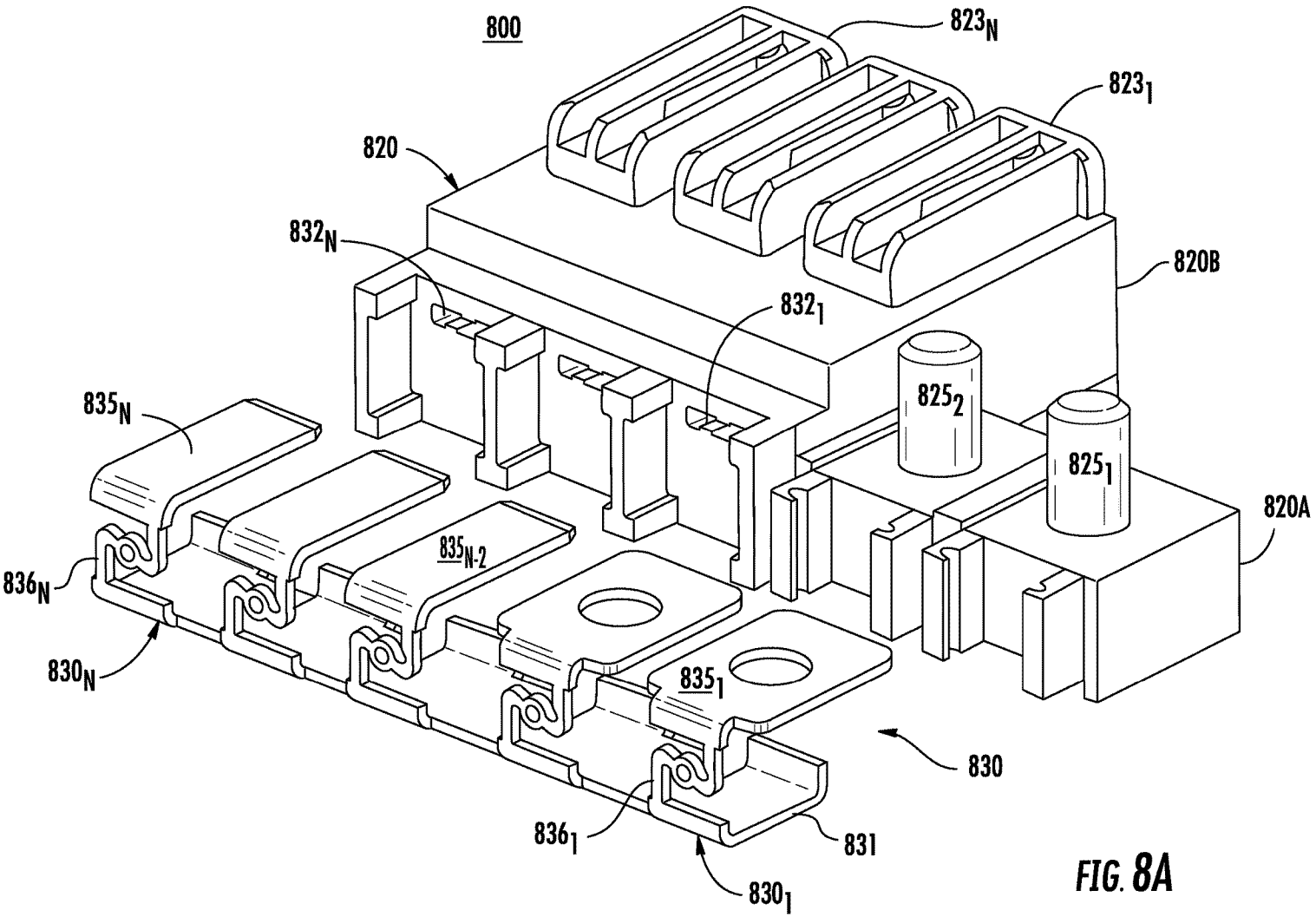
FIG. 8A is a perspective view of an exemplary embodiment in accordance with the present disclosure.
Figure 8B:
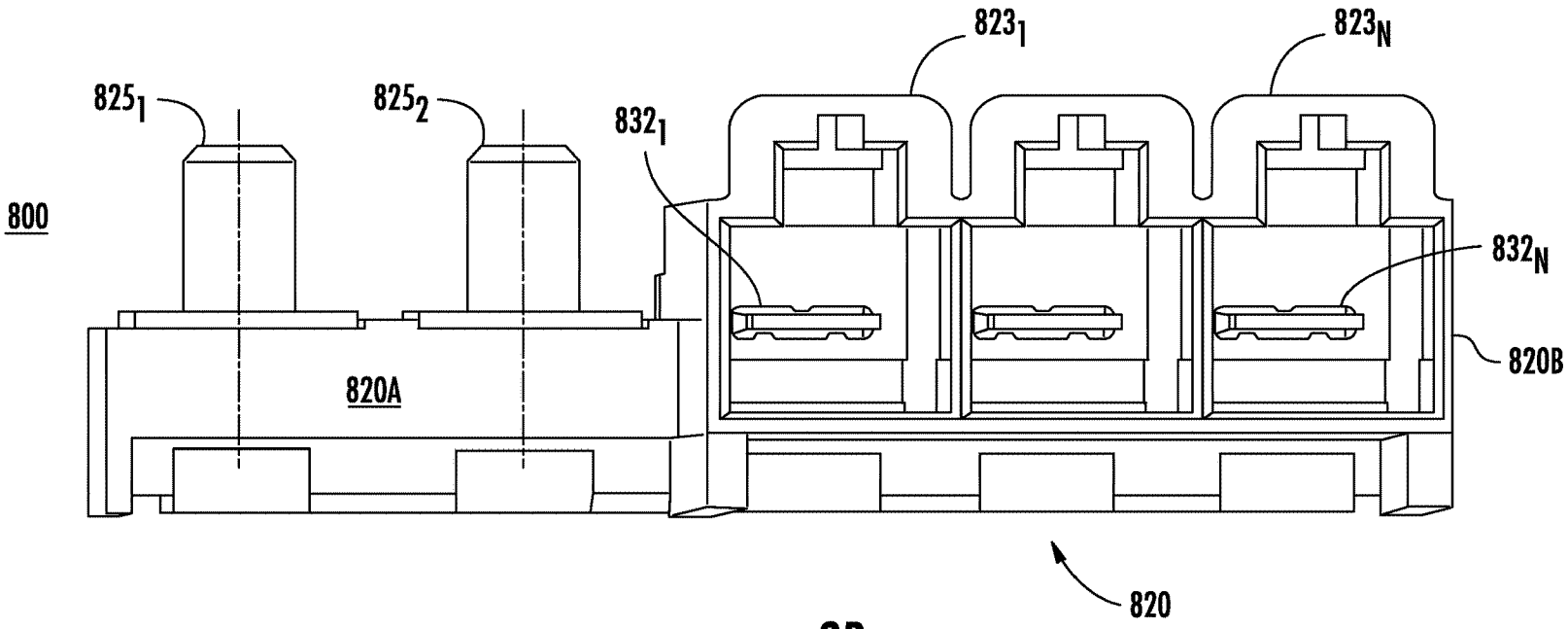
FIG. 8B is a side view of the exemplary embodiment shown in FIG. 8A in accordance with the present disclosure.

FIG. 8A is an exploded perspective view of an alternative embodiment of an assembly 800 in accordance with the present disclosure. In this embodiment, block 820 may be a unitary or multiple piece block with a first portion 820A configured with posts $\mathbf{825}_1$, $\mathbf{825}_2$ for connection to one or more connection cables and a second portion 820B receiving female fuse portions $\mathbf{835}_{N-2} \ldots \mathbf{835}_N$ as described below. A unitary assembly, shown generally as 830A, is defined by bus bar 831 and fuses $\mathbf{830}_1 \ldots \mathbf{830}_N$. The bus bar 831 forms the first terminal of each of the fuses and second terminals are illustrated as $\mathbf{835}_1 \ldots \mathbf{835}_N$ with fusible elements $\mathbf{836}_1 \ldots \mathbf{836}_N$ disposed therebetween, respectively. Terminals $\mathbf{835}_{N-2} \ldots \mathbf{835}_N$ may be configured as male terminals for insertion into recesses $\mathbf{832}_1 \ldots \mathbf{832}_N$. A plurality of locking portions $\mathbf{823}_1 \ldots \mathbf{823}_N$ are disposed on the top of block portion 820B to retain connection to each of the female fuse portions $\mathbf{835}_{N-2} \ldots \mathbf{835}_N$. This may be seen more clearly with reference to FIG. 8B which illustrates a side view of assembly 800. The recesses $\mathbf{832}_1 \ldots \mathbf{832}_N$ extend through block portion 820B to the other side thereof to receive a connection to the female fuse portions $\mathbf{835}_{N-2} \ldots \mathbf{835}_N$ which are retained in place via locking portions $\mathbf{823}_1 \ldots \mathbf{823}_N$.

Figure 9A:
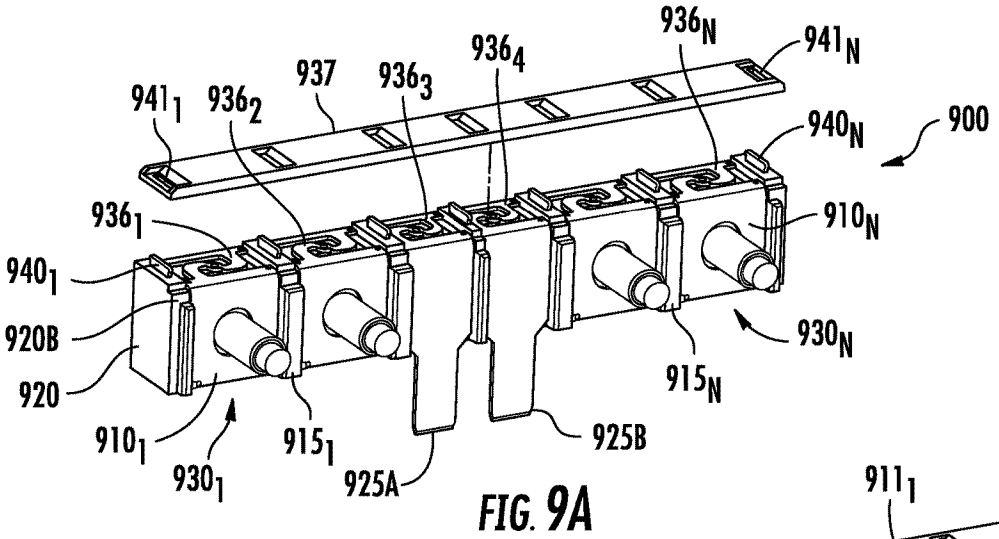
FIG. 9A is an exploded perspective view of an exemplary embodiment of the present disclosure.
Figure 9B:
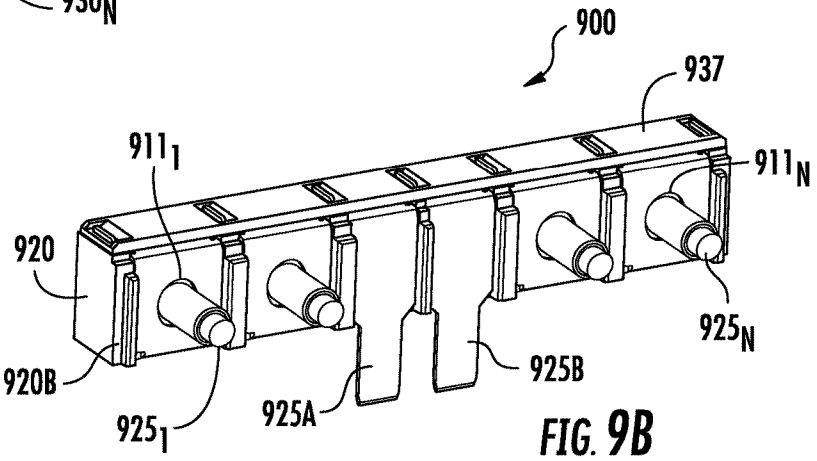
FIG. 9B is a perspective view of an exemplary embodiment of the present disclosure.
Figure 9C:
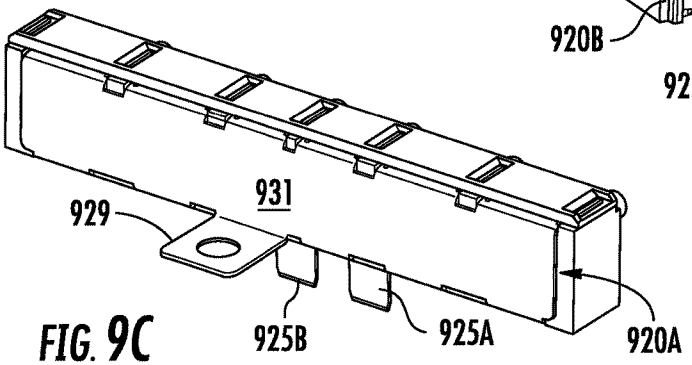
FIG. 9C is a perspective view of an exemplary embodiment of the present disclosure.

FIGS. 9A, 9B and 9C are various views of an assembly 900 in accordance with an alternative embodiment of the present disclosure. In particular, FIG. 9A is an exploded perspective view of block 920 accommodating a plurality of fuse assemblies $\mathbf{930}_1 \ldots \mathbf{930}_N$. Each fuse assembly $\mathbf{930}_1 \ldots \mathbf{930}_N$ comprises a first terminal portion $\mathbf{931}_1 \ldots \mathbf{931}_N$ and a second terminal portion $\mathbf{910}_1 \ldots \mathbf{910}_N$ with a fusible element $\mathbf{936}_1 \ldots \mathbf{936}_N$ connecting each of the first $\mathbf{931}_1 \ldots \mathbf{931}_N$ and second terminals $\mathbf{910}_1 \ldots \mathbf{910}_N$, respectively. Each of the first terminals $\mathbf{931}_1 \ldots \mathbf{931}_N$ of each fuse assembly $\mathbf{930}_1 \ldots \mathbf{930}_N$ is defined by a portion of bus plate 931 disposed on surface 920A of block 920. Each of the second terminals $\mathbf{910}_1 \ldots \mathbf{910}_N$, is disposed on surface 920B of block 920. A plurality of walls or fuse separators $\mathbf{915}_1 \ldots \mathbf{915}_N$ may be disposed between respective second terminal portions $\mathbf{910}_1 \ldots \mathbf{910}_N$ of fuse assemblies $\mathbf{930}_1 \ldots \mathbf{9301}_N$. Each of the fusible elements $\mathbf{936}_1 \ldots \mathbf{936}_N$ is disposed a distance away from respective side walls $\mathbf{915}_1 \ldots \mathbf{915}_N$ to accommodate heat dissipation from each of the corresponding fusible elements. A first 925A and second 925B plug or plug-in connectors form the first terminals of fuse assemblies $\mathbf{930}_3$ and $\mathbf{930}_4$ and extend from fusible elements $\mathbf{936}_3$ and $\mathbf{936}_4$. The first 925A and second 925B plug-in connectors may be connected to a lower rated circuit. A cover 937 is disposed over the fusible elements $\mathbf{936}_1 \ldots \mathbf{936}_N$ and attached to block 920 via tabs $\mathbf{940}_1 \ldots \mathbf{940}_N$ mating with cover apertures $\mathbf{941}_1 \ldots \mathbf{941}_N$, respectively. In addition to cover 937, recesses in block 920 defined between tabs 9401 . . . 940N may be used to further protect fusible elements $\mathbf{936}_1 \ldots \mathbf{936}_N$.

FIG. 9B illustrates a completed assembly 900 with cover 937 disposed on block 920. A plurality of posts $\mathbf{925}_1 \ldots \mathbf{925}_N$ extend from surface 920B of block 920. Each post may be at least partially disposed within a portion of block 920 and extend through a bore $\mathbf{911}_1 \ldots \mathbf{911}_N$ of respective second terminals $\mathbf{910}_1 \ldots \mathbf{910}_N$ of the corresponding fuse assembly $\mathbf{930}_1 \ldots \mathbf{930}_N$. In particular, an end of each post $\mathbf{925}_1 \ldots \mathbf{925}_N$ may be positioned within a recess of block 920 similar to the recess $\mathbf{226}_N$ of block 220 shown in FIG. 4B. This allows each post to extend from block 220 through the respective bores $\mathbf{911}_1 \ldots \mathbf{911}_N$ of terminal $\mathbf{910}_1 \ldots \mathbf{910}_N$ of each fuse assembly $\mathbf{930}_1 \ldots \mathbf{939}_N$ instead of extending through block 920.

FIG. 9C is another perspective view of assembly 900 illustrating bus bar 931, which extends the length of block 920 and forms the first terminal of each of the fuse assemblies $\mathbf{930}_1 \ldots \mathbf{930}_N$. A connection segment 929 extends from block 920 bus bar 931 and may be used to connect the fuse assemblies to a source of power such as a battery within a vehicle.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

What is claimed is:

1. A circuit protection assembly comprising:

a mounting block having a wall disposed substantially orthogonal to upper and lower surfaces, a recess cavity in said upper surface;

a plug connector extending from a portion of said upper surface in a direction parallel to said upper surface to form a first terminal;

a unitary fuse assembly disposed at least partially around said mounting block, said unitary fuse assembly having a bus plate disposed under said lower surface to form a second terminal and a fuse element disposed adjacent to said wall and substantially orthogonal to and connecting said first terminal to said second terminal;

a connection segment extending from the bus plate in a direction transverse to the upper surface for facilitating connection to a source of power;

a cover disposed over said fuse element and removably coupled to said wall;

a fourth fuse terminal disposed adjacent said upper surface and a third fuse element disposed substantially orthogonal to said fourth fuse terminal and adjacent to said wall, said fourth fuse terminal having a centrally disposed aperture aligned with said recess cavity; and a post partially disposed within said recess cavity and extending through said centrally disposed aperture.

2. The circuit protection assembly of claim 1, wherein said mounting block has a recess in said wall and said unitary fuse assembly comprises a terminal portion disposed in said recess to electrically connect said terminal portion to said first terminal.

3. The circuit protection assembly of claim 2, wherein said plug connector is a first plug connector, said portion of said upper surface is a first portion, and said fuse element is a first fuse element, said circuit protection assembly further comprising a second plug connector extending from a second portion of said upper surface to form a third terminal, said unitary fuse assembly having a second fuse element disposed adjacent to said wall and substantially orthogonal to and connecting said third terminal and said second terminal.

4. The circuit protection assembly of claim 3, wherein said recess is a first recess, said terminal portion is a first terminal portion, said mounting block has a second recess in said wall, and said unitary fuse assembly comprises a second terminal portion disposed in said second recess to electrically connect said second terminal portion to said third terminal.

5. The circuit protection assembly of claim 4, wherein said first fuse element is disposed a distance away from said wall to accommodate heat dissipation from said first fuse element.

* * * * *